US010492596B2

(12) United States Patent
Pegues

(10) Patent No.: US 10,492,596 B2
(45) Date of Patent: Dec. 3, 2019

(54) BRUSH ORGANIZER SYSTEM

(71) Applicant: Audrey Pegues, Hazelwood, MO (US)

(72) Inventor: Audrey Pegues, Hazelwood, MO (US)

( * ) Notice: Subject to any disclaimer, the term of this patent is extended or adjusted under 35 U.S.C. 154(b) by 0 days.

(21) Appl. No.: 15/683,759

(22) Filed: Aug. 22, 2017

(65) Prior Publication Data

US 2018/0220787 A1 Aug. 9, 2018

Related U.S. Application Data

(60) Provisional application No. 62/455,535, filed on Feb. 6, 2017.

(51) Int. Cl.

| | |
|---|---|
| ***A46B 17/02*** | (2006.01) |
| ***A45D 40/24*** | (2006.01) |
| ***A45D 44/00*** | (2006.01) |
| *A45D 33/00* | (2006.01) |

(52) U.S. Cl.

CPC ..... *A46B 17/02* (2013.01); *A45D 40/24* (2013.01); *A45D 44/00* (2013.01); *A45D 33/006* (2013.01)

(58) Field of Classification Search

CPC ..... A47L 13/512; A47G 29/08; A47B 17/02; A47B 17/04; A47B 17/00; B25H 3/04; B44D 3/123; A46B 15/0095; A46B 15/0097; A46B 15/0093; A47D 40/24; A45D 44/00; A45D 33/006

USPC ..... 211/65, 66

See application file for complete search history.

(56) References Cited

U.S. PATENT DOCUMENTS

| | | | | | |
|---|---|---|---|---|---|
| 1,314,625 | A * | 9/1919 | Wedin | A47K 10/04 | 15/160 |
| 2,121,307 | A * | 6/1938 | Swift | 15/104.001 | |
| 2,143,119 | A * | 1/1939 | Waring | A47G 25/746 | 211/85.3 |
| 2,591,805 | A * | 4/1952 | Gossett | B25H 3/04 | 211/124 |
| 2,643,840 | A * | 6/1953 | Lanman | A47G 1/168 | 174/158 R |
| 2,774,481 | A * | 12/1956 | Sievers | A47G 25/746 | 211/124 |
| 2,899,077 | A * | 8/1959 | Timms | B25H 3/04 | 211/70.6 |
| 2,956,687 | A * | 10/1960 | Robichaud | B65D 81/1075 | 165/90 |
| 3,286,847 | A | 11/1966 | LeBlanc et al. | | |
| 3,405,809 | A * | 10/1968 | Schatz | A47J 47/16 | 211/87.01 |
| 3,722,431 | A * | 3/1973 | Howard | A47B 3/00 | 108/157.13 |
| 3,819,039 | A * | 6/1974 | Erickson | A61B 17/06061 | 206/227 |
| 4,162,581 | A * | 7/1979 | O'Connor | G09B 19/00 | 434/259 |

(Continued)

*Primary Examiner* — Patrick D Hawn

(74) *Attorney, Agent, or Firm* — Charles Runyan

(57) ABSTRACT

A brush organizer system including a support assembly including a first-elongated-support member, a second-elongated-support member, and a base. The first-elongated-support member and the second-elongated-support member are positioned parallel and adjacent to one another creating a channel for inserting at least one item having a handle. The brush organizer system effectively holds and stores brushes in a neat and sanitary manner.

12 Claims, 5 Drawing Sheets

(56) References Cited

U.S. PATENT DOCUMENTS 4,177,903 A * 12/1979 Edelson ..... A47F 7/0007 211/59.2
4,265,362 A * 5/1981 Suonvieri ..... A46B 3/18 211/60.1
4,573,569 A * 3/1986 Parker ..... B44D 3/123 206/1.7
4,575,939 A * 3/1986 Buchtel ..... A47G 21/14 211/70.7
4,597,496 A * 7/1986 Kaplan ..... B25H 3/04 211/70.6
4,773,545 A * 9/1988 Jones ..... A47G 1/21 211/45
4,917,235 A * 4/1990 Feiler ..... A47F 7/022 206/566
5,005,710 A * 4/1991 Hofer ..... B25H 3/04 206/373
5,007,612 A * 4/1991 Manfre ..... A01K 97/00 220/DIG. 9
5,072,904 A * 12/1991 Taylor ..... A46B 17/00 211/65
5,419,443 A * 5/1995 Niederberger ..... A47L 13/512 211/70.6
5,450,970 A * 9/1995 Mitchell ..... A45D 24/38 211/65
5,515,969 A * 5/1996 Schonenbach ..... B25H 3/02 206/373
5,601,194 A * 2/1997 Brinston ..... H01H 9/025 211/26.1
5,738,228 A * 4/1998 Bittinger ..... A47F 7/0021 211/60.1
5,823,551 A * 10/1998 Conroy ..... B62B 5/0083 280/47.131
5,842,566 A * 12/1998 White ..... A47F 5/11 206/362
5,947,276 A * 9/1999 Hsu ..... B43M 99/006 206/214
6,202,862 B1 * 3/2001 Acquaviva ..... B43K 21/003 211/60.1
6,283,314 B1 * 9/2001 Loguercio ..... D06F 57/06 211/200
6,763,955 B2 * 7/2004 Keis ..... A47J 47/16 211/60.1
7,303,568 B2 * 12/2007 Jannot ..... A61B 17/06061 606/148
7,591,382 B2 9/2009 Brock
7,717,277 B2 * 5/2010 Meinhardt ..... B25H 3/025 206/373
8,096,430 B2 * 1/2012 Lim ..... A47B 47/00 211/195
8,162,156 B1 * 4/2012 Crisman ..... G10D 13/003 211/10
8,286,790 B1 10/2012 McBryar
8,317,138 B1 * 11/2012 Johnson, Jr. ..... A45F 3/46 206/349
9,210,996 B1 12/2015 Kramer
2004/0134867 A1 * 7/2004 Kin ..... A47F 5/137 211/45
2009/0184068 A1 * 7/2009 Kin ..... A47F 7/163 211/45
2013/0328467 A1 * 12/2013 Carlton ..... A47F 7/0028 312/280
2014/0325779 A1 11/2014 Dansby
2014/0332642 A1 11/2014 Lim

* cited by examiner

BRUSH ORGANIZER SYSTEM

CROSS REFERENCE TO RELATED APPLICATION

The present application is related to and claims priority to U.S. Provisional Patent Application No. 62/455,535 filed Feb. 6, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of brush stands and more specifically relates to a brush organizer system.

2. Description of Related Art

Many people use brushes for various purposes. A brush is a tool with bristles, wire or other filaments, used for cleaning, grooming hair, make up, painting, surface finishing and for many other purposes. The material of both the block and bristles or filaments is chosen to withstand hazards of its application. Brushes may also be used in sterile applications. Individuals who own a collection of makeup brushes often have difficulty finding a suitable location to safely store the brushes. They often end up creating clutter on a table or sink and it can be difficult to find the desired brush when needed. The brushes also tend to clump together and grow bacteria when not properly stored. Cleaning and drying the brushes is also a burden and there is not an ideal location to keep the brushes during this process. This is also true of artists who use paintbrushes. An efficient method of organizing the brushes is desired.

U.S. Pat. No. 9,210,996 to Dorothy L. Kramer relates to a magnetic cosmetic brush stand and sleeve. The described magnetic cosmetic brush stand and sleeve includes a cosmetic brush stand having a horizontal base and a vertical portion extending upward therefrom. The vertical portion has a front surface and a rear surface with magnetic strips located on either of both surfaces. Cosmetic brushes are attracted to the magnetic strips via ferrules made of a ferrous metal, a magnetized metal or an attachment sleeve placed thereon. The magnetized sleeve may be used on conventional brushes having non-ferrous metal ferrules. A tray having individual slots or apertures may be located on the front surface and/or the rear surface to further secure the brushes to the brush stand. The brush stand may also be rotatable to provide easy access to the front surface and rear surface.

BRIEF SUMMARY OF THE INVENTION

In view of the foregoing disadvantages inherent in the known brush stand art, the present disclosure provides a novel brush organizer system. The general purpose of the present disclosure, which will be described subsequently in greater detail, is to provide a brush organizer that effectively holds and stores makeup brushes in a neat, convenient, and sanitary manner.

A brush organizer system is disclosed herein. The brush organizer system includes a support assembly having a first-elongated-support member, a second-elongated-support member, and a base. The first-elongated-support member and the second-elongated-support member are positioned parallel and adjacent to one another creating a 'channel' for inserting at least one item having a handle. The at least one item may comprise a brush for example. The brush may include a makeup application brush, a paintbrush, or other handheld item having a handle.

The first-elongated-support member and the second-elongated-support member comprise an elevated positioning above the base via vertical dowels during use. The vertical dowels support the first-elongated-support member and the second-elongated-support member at opposing ends. The first-elongated-support member and the second-elongated-support member comprise a greater length than the vertical dowels. The at least one item is able to be positioned vertically for ease of removing and alternately inserting the at least one item.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a brush organizer system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a brush stand and more particularly to a brush organizer system as used to improve the organization and storage of brushes and other handheld items having an elongated handle.

Generally, the present invention provides a brush organizer that effectively holds and stores makeup brushes in a neat and sanitary manner. It offers an ideal location for artists to store and dry their paintbrushes and prevent them from being damaged. This enables makeup artists and makeup enthusiasts to display and organize their brushes in a manner that makes it easy to select the desired brush. It includes the capability and means to hang wet brushes upside down for drying purposes.

The present invention keeps counter and table space free of clutter when applying makeup or painting. Brush organizer offers make up users and artists a secure and sanitary location for storing and drying brushes. The invention is preferably comprised of a heavy flat wood base with two shorter wood dowels close to the end. Two longer dowels are laid length wise to sit on top of the shorter vertical dowels. The dowels may be covered with a memory foam to grip the brushes. The foam tubes may be covered in a felt material for makeup brushes and a leather option is available for paintbrushes. The brushes may be inserted between the foam dowels or hung upside down for drying purposes. The unit may be created in various materials and colors.

Figure 1:
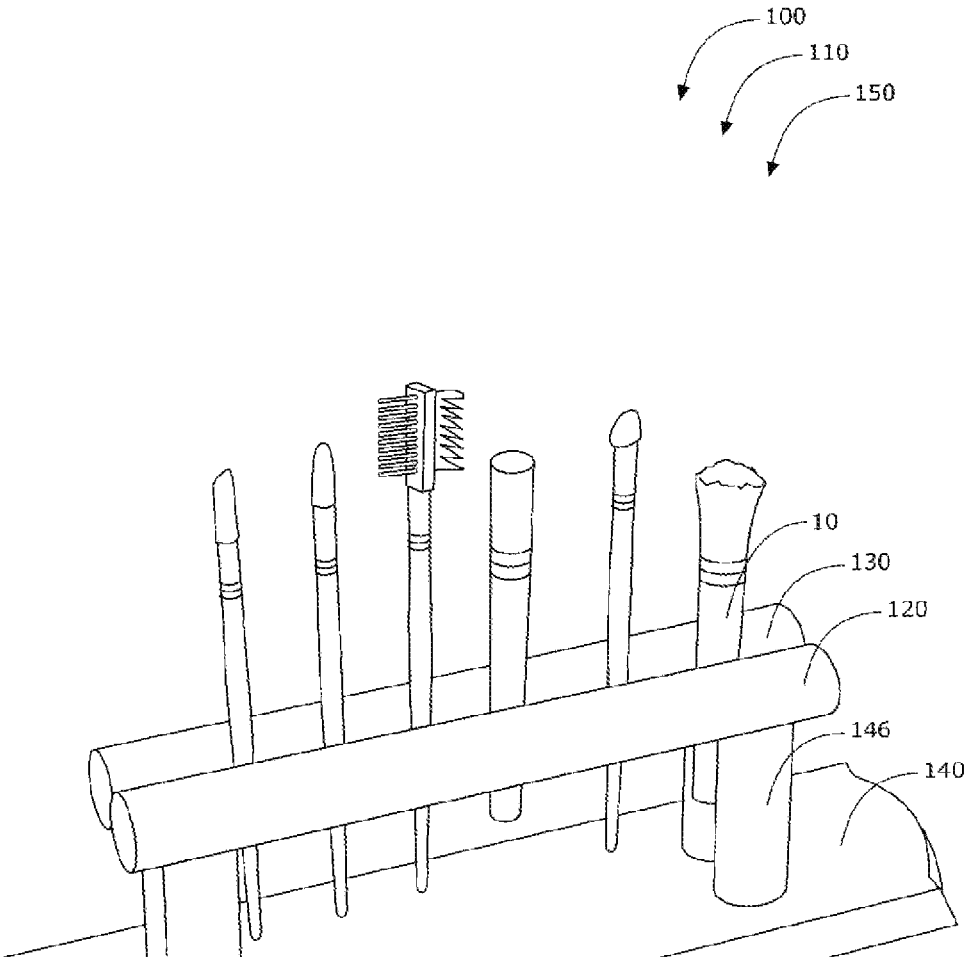
FIG. 1 is a perspective view of the brush organizer system during an 'in-use' condition, according to an embodiment of the disclosure.

Referring now more specifically to the drawings by numerals of reference, there is shown in FIGS. 1-5, various views of a brush organizer system 100. FIG. 1 shows a brush organizer system 100 during an 'in-use' condition 150, according to an embodiment of the present disclosure. As illustrated, the brush organizer system 100 may include support assembly 110 having first-elongated-support member 120, a second-elongated-support member 130, and a base 140. The first-elongated-support member 120 and the second-elongated-support member 130 comprise an elevated positioning above the base 140 via vertical dowels 146 during use. The vertical dowels 146 support the first-elongated-support member 120 and the second-elongated-support member 130 at opposing ends. The first-elongated-support member 120 and the second-elongated-support member 130 comprise a greater length than the vertical dowels 146 in preferred embodiments. At least one item 10 is able to be positioned vertically for ease of removing and alternately inserting the at least one item 10.

Figure 2:
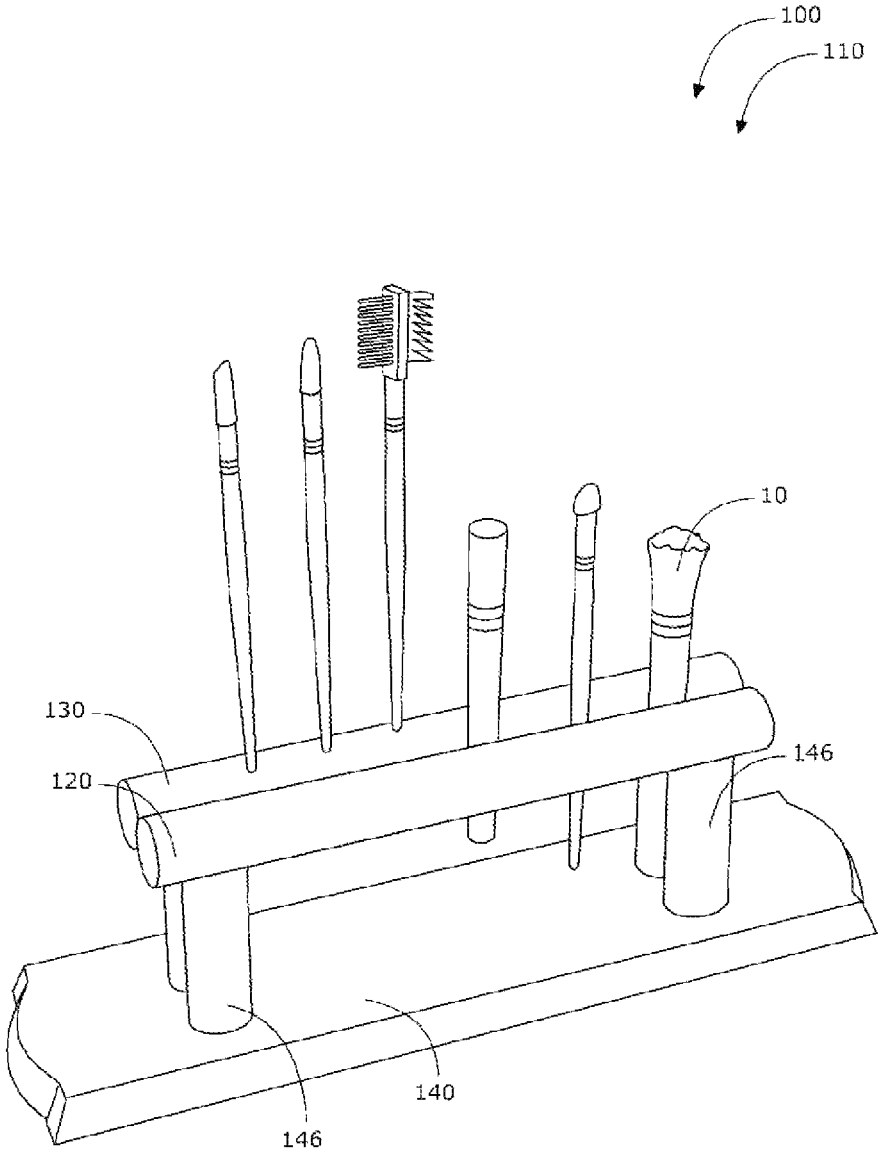
FIG. 2 is a perspective view of the brush organizer system of FIG. 1, according to an embodiment of the present disclosure.

FIG. 2 shows a perspective view of the brush organizer system 100 of FIG. 1, according to an embodiment of the present disclosure. As above, the brush organizer system 100 may include a support assembly 110 including a first-elongated-support member 120, a second-elongated-support member 130, and a base 140. The brush organizer system 100 comprises the support assembly 110. The support assembly 110 comprises the first-elongated-support member 120 and the second-elongated-support member 130.

Figure 3:
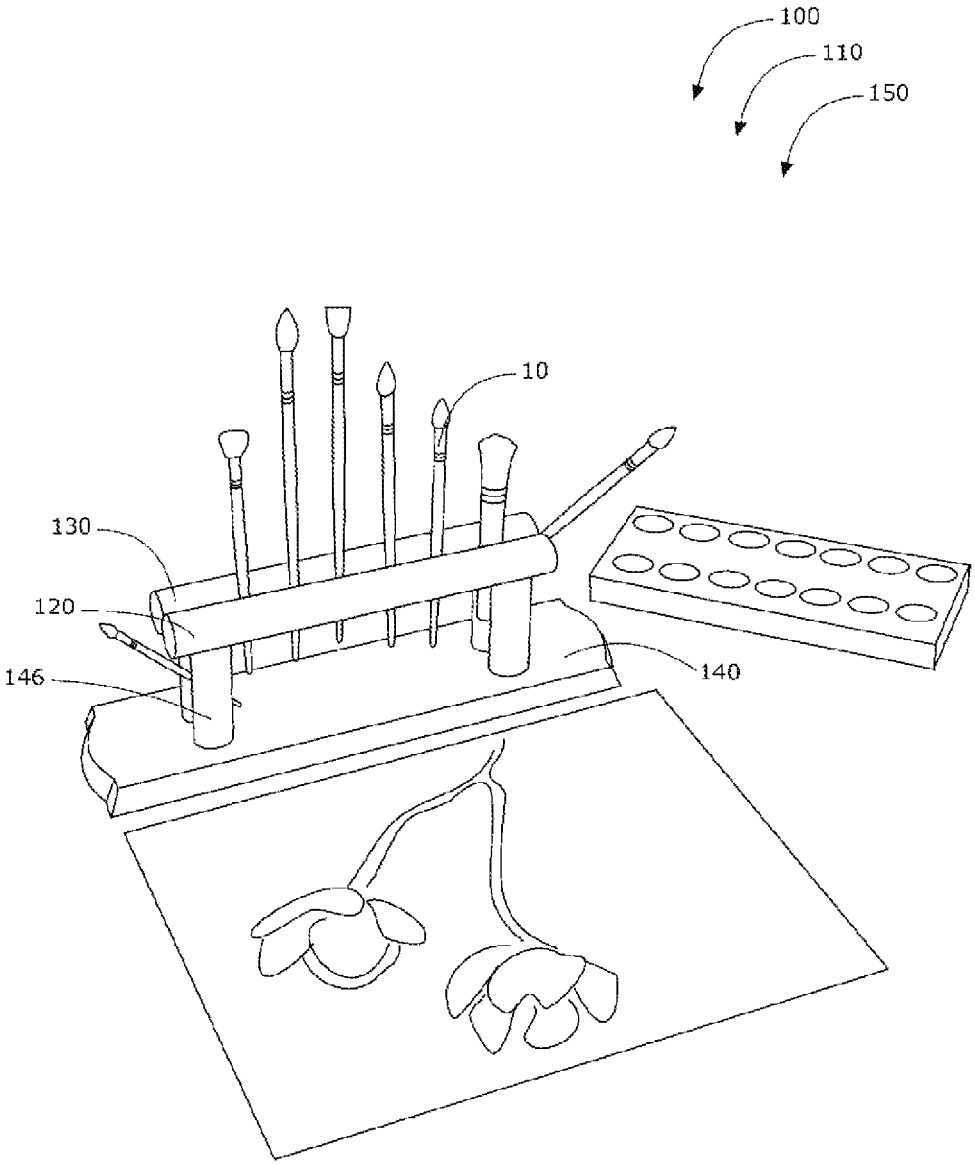
FIG. 3 is a perspective view of the brush organizer system of FIG. 1, according to an embodiment of the present disclosure.

FIG. 3 shows another perspective view of the brush organizer system 100 of FIG. 1, according to an embodiment of the present disclosure. As above, the brush organizer system 100 may include a support assembly 110 including a first-elongated-support member 120, a second-elongated-support member 130, and a base 140. The first-elongated-support member 120 and the second-elongated-support member 130 are positioned parallel and adjacent to one another creating a channel for inserting at least one item 10 having a handle. The vertical dowels 146 may be located at opposing sides of each of the first-elongated-support member 120 and the second-elongated-support member 130 and connect to the base 140. The base 140 may be rigid and comprise a substantially 3-D rectangular profile. The channel of the support assembly 110 is configured to support the at least one item 10 having the handle.

Figure 4:
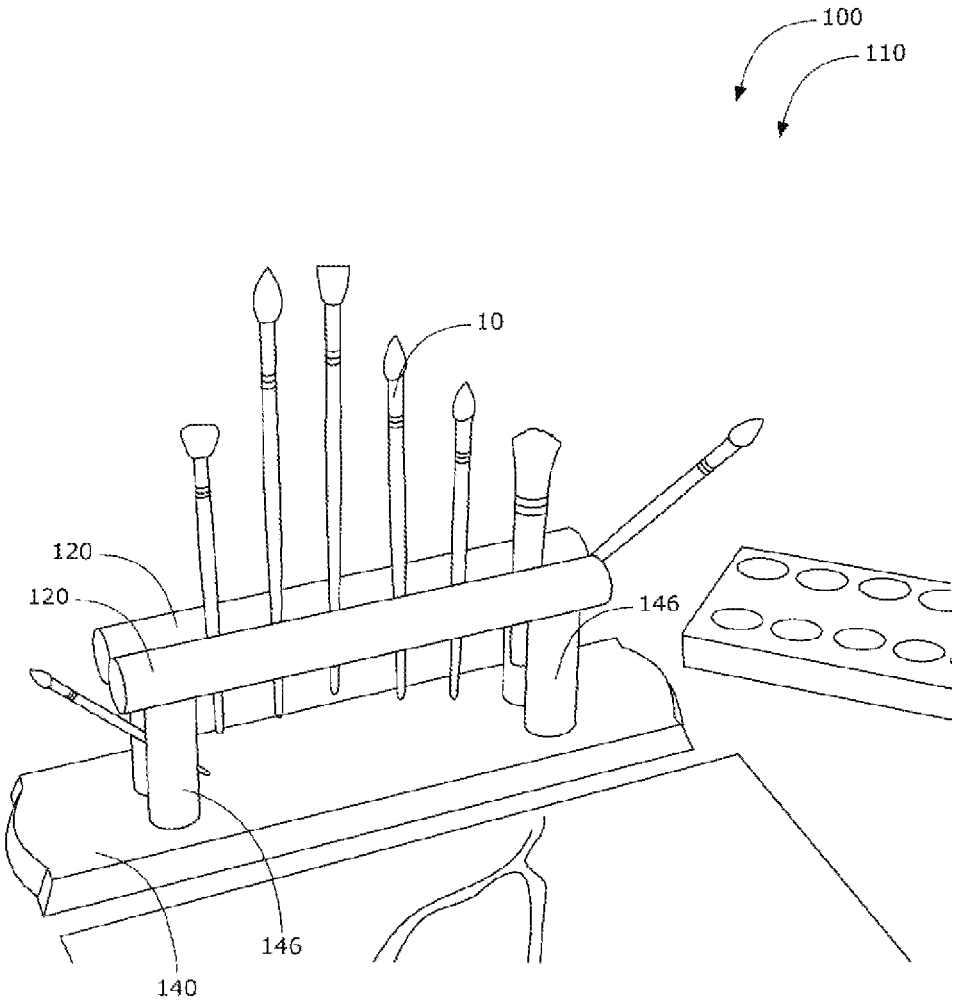
FIG. 4 is a perspective view of the brush organizer system of FIG. 1, according to an embodiment of the present disclosure.

FIG. 4 shows a perspective view of the brush organizer system 100 of FIG. 1, according to an embodiment of the present disclosure. As above, the brush organizer system 100 may include a support assembly 110 including a first-elongated-support member 120, a second-elongated-support member 130, and a base 140. The first-elongated-support member 120 and the second-elongated-support member 130 comprise an elongated cylindrical profile in certain embodiments. The vertical dowels 146 comprise a cylindrical profile creating support legs. The vertical dowels 146 may support the first-elongated-support member 120 and the second-elongated-support member at opposing ends. The first-elongated-support member and the second-elongated-support member 130 may comprise a greater length than the vertical dowels 146.

Figure 5:
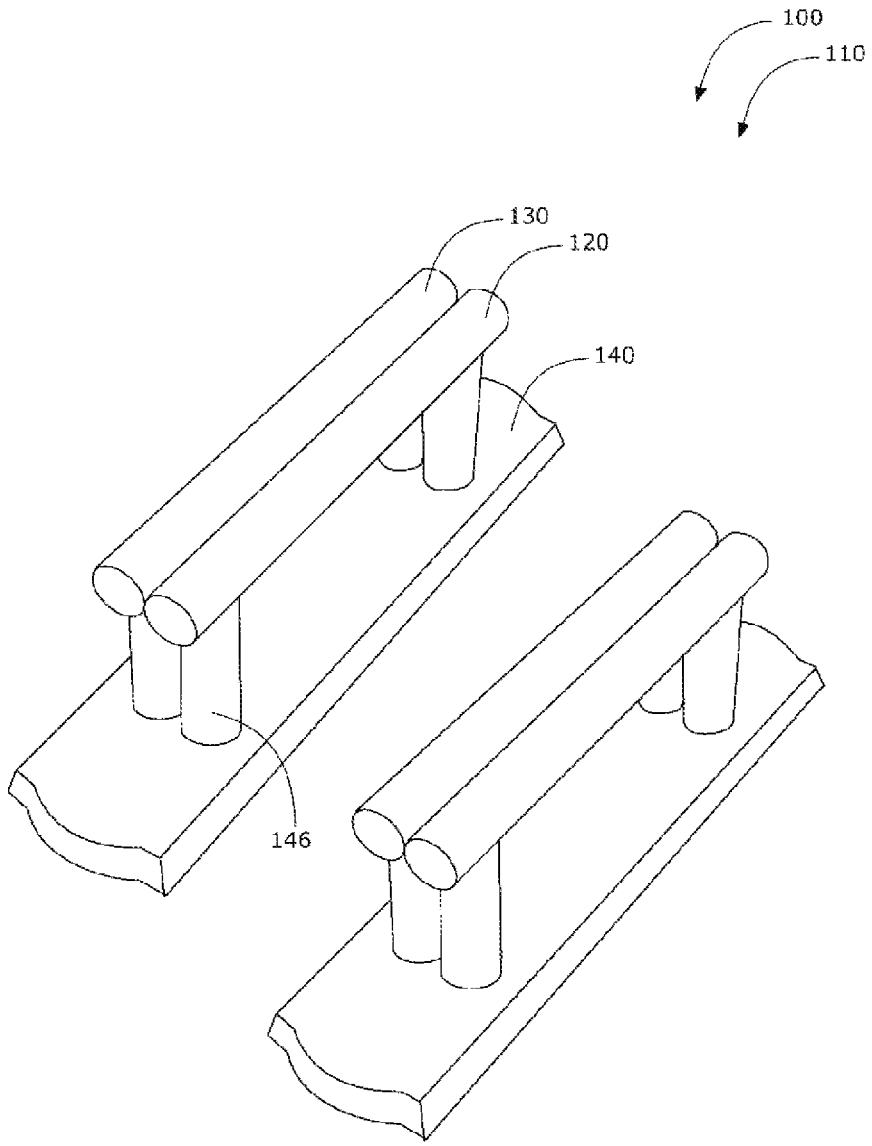
FIG. 5 is a perspective view of the brush organizer system of FIG. 1, according to an embodiment of the present disclosure.

FIG. 5 shows a perspective view of the brush organizer system 100 of FIG. 1, according to an embodiment of the present disclosure. As above, the brush organizer system 100 may include a support assembly 110 including a first-elongated-support member 120, a second-elongated-support member 130, and a base 140. The first-elongated-support member 120, the second-elongated-support member 130, and the vertical dowels 146 comprise a semi-flexible body. The first-elongated-support member 120, the second-elongated-support member 130, and the vertical dowels 146 may comprise a fabric exterior lining housing the flexible body comprising the foam such as memory foam. The semi-flexible body comprises foam configured to receive and secure at least one item of varying sizes. The flexible body comprising the foam creates the channel between the first-elongated-support member 120, the second-elongated-support member 130, and the vertical dowels 146 are configured to receive and secure at least one item 10 of varying sizes. The at least one item 10 may comprise a brush. The brush may include a makeup application brush, a paintbrush, or other handheld item having a handle. The at least one item 10 is able to be positioned vertically for ease of removing and alternately inserting the at least one item 10.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A brush organizer comprising:

a base;

two pairs of dowels extending vertically from the base;

a first horizontal dowel-shaped member extending across one of the two pairs of dowels;

a second horizontal dowel-shaped member disposed parallel to and near the first horizontal member and extending across the other of the two pairs of dowels; and compressible material disposed around each of the horizontal members such that the compressible material compresses to hold a brush handle, wherein both the first and second horizontal members are longer than the vertical dowels; and wherein all of the dowels have a round cross-section.

2. The brush organizer of claim 1 further comprising compressible material disposed around each of the vertical dowels.

3. The brush organizer of claim 2 wherein some of the compressible material is cylindrical.

4. The brush organizer of claim 3 wherein a flexible liner is disposed around the compressible material.

5. The brush organizer of claim 4 wherein the flexible liner comprises plastic or fabric.

6. The brush organizer of claim 5 wherein the compressible material is a foam.

7. The brush organizer of claim 6 wherein the foam is a memory foam.

8. The brush organizer of claim 5 wherein the compressible material of the first horizontal member touches the compressible material of the second horizontal member.

9. The brush organizer of claim 1 wherein the base is rigid and holds the dowels extending vertically from the base in a fixed relationship.

10. The brush organizer of claim 9 wherein the first and second horizontal dowel-shaped member and the compressible material around each of the horizontal members offers lateral support to one or more tools inserted between the first and second horizontal dowel-shaped members.

11. The brush organizer of claim 2 wherein the compressible material disposed around each of the vertical dowels offers lateral support to one or more tools inserted between the vertical dowels.

12. A brush organizer comprising:

a base;

two pairs of dowels extending vertically from the base;

a first horizontal member extending across one of the two pairs of dowels;

a second horizontal member disposed parallel to and near the first horizontal member and extending across the other of the two pairs of dowels;

and compressible material disposed around each of the horizontal members and vertical dowels such that the compressible material compresses to hold a brush handle.

* * * * *